US005628892A

United States Patent [19]

Kawashima et al.

[11] Patent Number: 5,628,892

[45] Date of Patent: May 13, 1997

[54] ELECTROPLATING METHOD AND APPARATUS FOR THE PREPARATION OF METAL FOIL AND SPLIT INSOLUBLE ELECTRODE USED THEREIN

[75] Inventors: Yukio Kawashima, Tokyo; Kazuhide Ohe, Chiba; Hiroyuki Nakada, Tokyo, all of Japan

[73] Assignee: TDK Corporation, Tokyo, Japan

[21] Appl. No.: 245,076

[22] Filed: May 17, 1994

Related U.S. Application Data

[63] Continuation of Ser. No. 9,953, Jan. 27, 1993, abandoned.

[30] Foreign Application Priority Data

Feb. 7, 1992 [JP] Japan ..... 4-056815

[51] Int. Cl.[6] ..... C25D 1/20; C25D 1/04; C25D 7/06; C25D 17/00

[52] U.S. Cl. ..... 205/77; 205/137; 205/292; 204/216; 204/227; 204/290 R; 204/290 F; 204/280

[58] Field of Search ..... 205/137, 143, 205/138, 292; 204/212, 280, 286, 288, 297 R, 272, 275, 290 F, 242

[56] References Cited

U.S. PATENT DOCUMENTS

| | | | |
|---|---|---|---|
| 4,318,794 | 3/1982 | Adler | 204/216 |
| 4,936,971 | 6/1990 | Pohto | 204/242 |
| 4,956,053 | 9/1990 | Polan et al. | 204/13 |
| 5,017,275 | 5/1991 | Niksa et al. | 204/206 |

FOREIGN PATENT DOCUMENTS

| | | |
|---|---|---|
| 0682872 | 3/1964 | Canada . |
| 53-5036 | 1/1978 | Japan . |
| 53-100138 | 9/1978 | Japan . |
| 1-149465 | 10/1989 | Japan . |
| 1-56153 | 11/1989 | Japan . |
| 1-290799 | 11/1989 | Japan . |
| 2-136059 | 11/1990 | Japan . |
| 3-170699 | 7/1991 | Japan . |
| 3-183792 | 8/1991 | Japan . |

*Primary Examiner*—Donald R. Valentine
*Attorney, Agent, or Firm*—Oblon, Spivak, McClelland, Maier & Neustadt, P.C.

[57] ABSTRACT

A length of electroplated metal foil, typically copper foil is prepared by placing a stationary arcuate anode concentrically with a rotating cathode drum to define a channel therebetween, passing a plating solution through the channel, conducting electricity across the channel for depositing metal on the cathode drum, and separating the metal deposit from the cathode drum. The anode includes a plurality of circumferentially arranged electrode segments formed of a valve metal material and coated with a platinum group metal or oxide thereof. The electrode segments are removably attached and electrically connected to a back plate. The split anode is easy in assembly and disassembly and, hence, in maintenance and repair, has a high degree of precision in configuration and dimensions, and ensures manufacture of copper foil of quality with a minimized variation in thickness during continuous operation.

16 Claims, 4 Drawing Sheets

ELECTROPLATING METHOD AND APPARATUS FOR THE PREPARATION OF METAL FOIL AND SPLIT INSOLUBLE ELECTRODE USED THEREIN

This application is a continuation of application Ser. No. 08/009,953, filed on Jan.27, 1993, now abandoned.

BACKGROUND OF THE INVENTION

1. Field of the Invention

This invention relates to an electroplating method and apparatus for producing a length of metal foil, typically copper foil and a split insoluble anode used therein.

2. Prior Art

Printed circuit boards are in widespread use in a variety of fields. The printed circuit boards use copper foil which is commonly produced by electroplating. In the manufacture of electroplated copper foil, it is essential that the foil is free of point defects such as pinholes and anomalous deposits and has a uniform thickness.

In the conventional manufacture of electrolytic copper foil, the cathode is a rotating drum of titanium or stainless steel (SUS) and the anode is a pair of lead plates having an arcuate cross section corresponding to approximately a quarter of the drum circumference. The anode plates are disposed below and concentrically with the cathode drum to define a channel between the cathode drum and the anode and a lower opening or slit between the anode plates. A plating solution is supplied into the channel through the lower slit. Reference to FIG. 8 will help in the understanding of this arrangement. Direct current is conducted between the cathode and anode to deposit copper on the cathode drum. A length of copper foil is continuously separated from the drum and taken up on a roll.

The anode used in the prior art is generally formed of pb or binary or multi-component alloys of pb with Sb, Sn, Ag, In, Ca or the like. Then during electroplating, lead oxide forms on the anode surface and leaches into the electrolytic solution in the form of pb ions which, in turn., react with sulfate ions in the solution to form lead sulfate which is suspended in the solution. The lead sulfate sludge can be removed by providing a filter in the bath, but the filter requires more manpower for maintenance. If sludge removal is insufficient, it can accumulate on the inner walls of the bath and pipings, obstructing the solution flow. If lead sulfate sludge sticks to the cathode drum, point defects such as pinholes and anomalous deposits would occur in the copper foil. These defects are critically detrimental to the copper foil.

The use of lead electrodes has the drawback that lead can be locally worn out by current concentration and erosion, resulting in a local variation in the cathode-to-anode distance. One solution is to periodically machine the lead anode which leads to not only a lowering of working factor, but also an increased cathode-to-anode distance which in turn, leads to an increased bath voltage and an increased cost. The variation in the cathode-to-anode distance causes a variation in copper foil thickness in a transverse direction.

To prevent occurrence of pinholes and anomalous deposits caused by sulfate sludge and to eliminate a transverse thickness variation of copper foil due to a varying cathode-to-anode distance resulting from lead wear, Japanese Patent Publication (JP-B) No. 56153/1989 discloses an insoluble anode formed of a valve metal substrate such as Ti, Ta, Nb and Zr and coated with a catalytic coating of a platinum group metal or an oxide thereof as the arcuate plate-shaped anode opposed to the cathode drum.

However, this anode is still susceptible to local wear and short-circuiting due to anomalous copper deposition on the cathode drum. Since this anode is a one-piece arcuate plate, the entire anode must be removed and exchanged for repairing such failure. As a result, the operation of maintenance and repair including handling of the anode for mounting in the plating system is cumbersome and time-consuming, the cost of maintenance and the capital equipment are increased, and the plating system has a low working factor.

More undesirably, the use of a one-piece arcuate plate anode is susceptible to concentration of current density at the edges during electric conduction which is known as edge effect. In particular, the edge effect causes current flow to concentrate near the edges of the anode plates which delimit the inlet slit for plating solution, causing local wear of the catalytic coating of the anode plates which results in a length of copper foil varying in thickness in a transverse direction. This foil thickness variation increases during continuous operation and eventually beyond a practically acceptable level, meaning that the anode has a short life. This phenomenon becomes more serious in the manufacture of copper foil which is as thin as 20 μm or less. In fact, the above-referred JP-B 56153/1989 reports a foil thickness variation within 2% in the manufacture of 18-μm thick copper foil. The state-of-the-art is not successful in achieving a foil thickness variation within 1%. Other drawbacks are difficulty to form a coating on a large arcuate substrate and non-uniformity of coating thickness.

SUMMARY OF THE INVENTION

Therefore, a primary object of the present invention is to provide an electroplating method for producing a length of electroplated metal foil, typically copper foil, having a minimized variation of thickness. Another object of the present invention is to provide an electroplating apparatus for producing a length of metal foil which is easy in maintenance and repair. A further object of the present invention is to provide a split insoluble electrode adapted for use in such a method and apparatus.

Briefly stated, a split insoluble anode according to the present invention is generally arcuate and includes a plurality of circumferentially arranged electrode segments, a back plate, and conductive fixtures for removably attaching the electrode segments to the back plate. Each electrode segment is formed of a valve metal substrate coated with a platinum group metal or an oxide thereof.

The split insoluble anode is used in an electroplating method for producing a length of electroplated metal foil. The method includes the steps of: placing a rotating cathode drum and the anode at a predetermined spacing therebetween, providing an electroplating solution containing a metal between the cathode drum and the anode, conducting electricity between the cathode drum and the anode for depositing the metal on the cathode drum, and separating the metal deposit from the cathode drum, thus obtaining a length of electroplated metal foil.

Also contemplated herein is an electroplating apparatus. The anode is disposed around the cathode drum adapted to rotate about an axis to define a channel having a predetermined radial distance therebetween. The apparatus further includes means for supplying an electroplating solution containing a metal to the channel, means for conducting electricity between the cathode drum and the anode for depositing the metal on the cathode drum, and means for separating the metal deposit from the cathode drum, obtaining a length of electrolytic metal foil.

In a preferred embodiment, the cathode drum and the anode are dipped in a tank filled with the electroplating solution, and the electroplating solution is pumped to flow through the channel. Preferably, the electrode segments define arcuate surfaces, respectively, which are disposed concentrically with the cathode drum. The electrode segments on their arcuate surface are separated a distance of 0.1 to 5 mm. A pair of anodes are disposed concentrically around the cathode drum such that the anodes occupy second and third quadrants about the drum axis as viewed in a vertical cross section, respectively. The anode extends an arc having an included angle of 45° to 120° with respect to the drum axis. The channel between the anode and the cathode drum has a radial distance of about 10 mm.

Most often, the metal is copper and the electrolytic metal foil is copper foil of up to 70 μm thick.

The split insoluble electrode according to the present invention is easy in maintenance and repair. An arcuate plate is circumferentially divided into a plurality of segments or strips which are axially elongated and circumferentially arcuate. Then both manufacture of electrode segments and assembly of segments into an anode are easy, and the precision of assembly is high. The electrode segments have a high degree of precision in configuration and dimensions and bear a catalytic coating of uniform thickness.

The present invention is successful in reducing a variation in thickness of an extremely thin metal foil by dividing an anode plate into a plurality of electrode segments to increase the number of edges or the overall edge length on the anode surface, thereby blurring the edge effect and achieving a more uniform current flow distribution. This feature also reduces the increase with time of the edge effect during continuous operation and thus extends the life of the electrode segments. Then the anode has a longer effective life.

For various conventional types of electroplating, the use of split electrodes is well known in the prior art. For example, Japanese U.M. Application Kokai No. 149465/1989 discloses an arrangement for electroplating a steel strip in which the steel strip is continuously and linearly moved through a plating bath relative to a planar anode which is divided parallel to the direction of travel of the strip (see FIGS. 4 and 5 of the patent gazette). If an anode plate is divided parallel to the rotational direction of a rotating cathode drum, the respective segments should have an equal arc of a substantial length. It is very difficult to coat such relatively long arc segments of valve metal with a coating of platinum group metal or oxide, especially difficult where a uniform thickness is desired. Additionally and more importantly, if an electrode plate is divided parallel to the travel or rotational direction of a member to be plated (which is a steel strip or cathode drum as the case may be), the distribution of current density becomes non-uniform, resulting in a deposit film having defects in the form of longitudinal streaks and a thickness variation in the transverse direction beyond a practically acceptable level. This problem is not referred to in the above-cited patent gazette.

Also, regarding a technique for electroplating a steel strip while continuously and linearly moving the steel strip, Japanese patent Application Kokai No. 176100/1989 and Japanese U.M. Application Kokai No. 136058/1990 disclose a split electrode comprised of a multiplicity of electrode segments which are obtained by dividing an electrode plate both longitudinally and transversely (that is, a strip travel direction and a direction perpendicular thereto). However, if an arcuate electrode plate is divided both axially and circumferentially, there are too many electrode segments to assemble with acceptable labor. The precision of assembly is low enough to allow for local wear of electrode segments and anomalous copper deposition. Therefore, this approach rather adds to the difficulty of maintenance and repair. Further, transverse division contributes to the occurrence of film thickness variation.

The present invention which uses a relatively simple structure as defined above eliminates all the problems encountered when conventional split electrodes of the flat plate type are directly applied to electrodes of the arcuate plate type.

Moreover, JP-B 18902/1974 discloses an apparatus for preparing a magnetic thin film comprising an annular electrolytic tank disposed around a cathode roller. The tank is divided by a plurality of partitions into a plurality of separate compartments where separate anodes are disposed. This arrangement is somewhat similar to the present invention in that the anodes are separated. However, since the anodes are kept separate and not assembled into an anode assembly, the plating solution generates vortex flow at the gaps between the anodes, resulting in a film of varying thickness. The plating solution experiences a variation in its composition among the separate compartments. The apparatus is complicated as a whole and difficult to control.

DESCRIPTION OF THE PREFERRED EMBODIMENTS

The insoluble electrode or anode of the present invention includes a plurality of electrode segments which are removably attached to a back plate by conductive fixtures for shape retention, reinforcement and conduction purposes. The segmented insoluble electrode is described in further detail.

Figure 1:
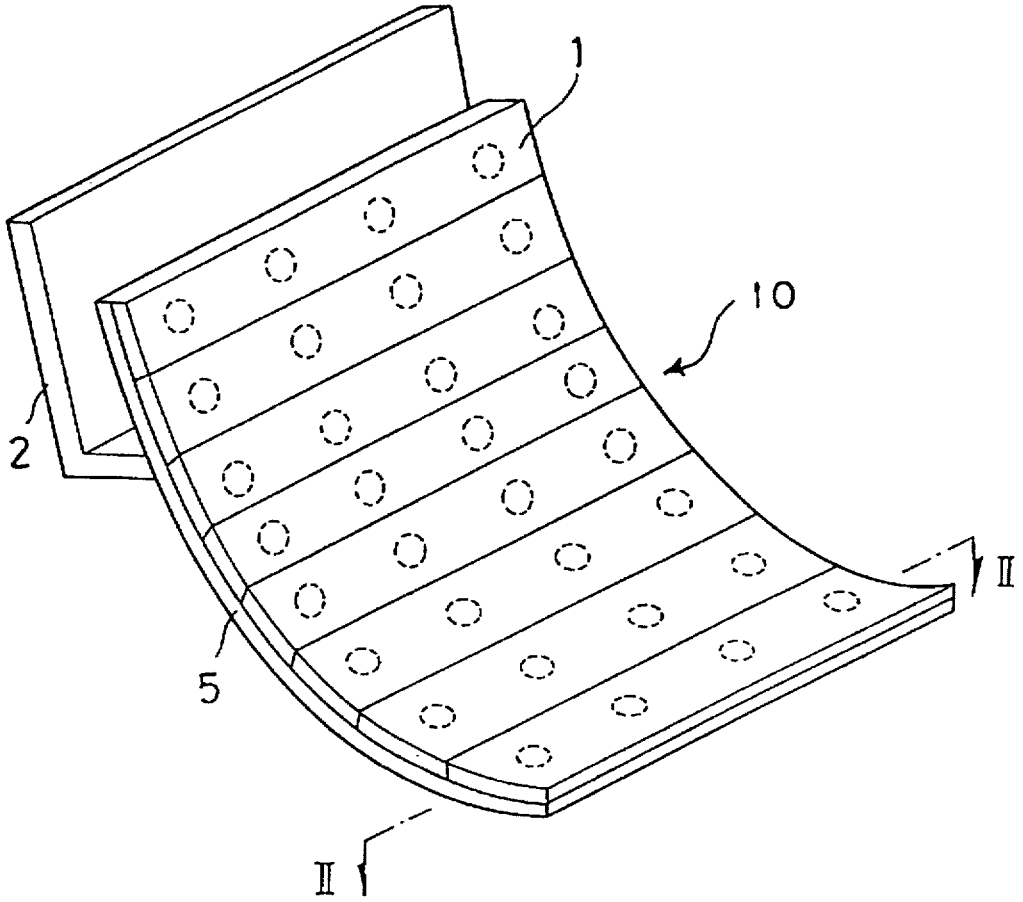
FIG. 1 is a perspective view of a segmented insoluble electrode according to one embodiment of the present invention.
Figure 2:
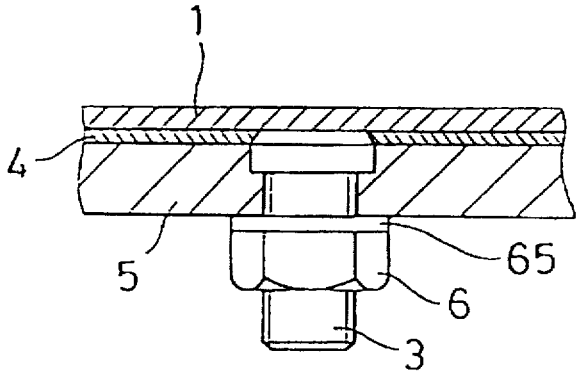
FIG. 2 is a cross-sectional view of the electrode taken along lines II—II in FIG. 1.
Figure 3:
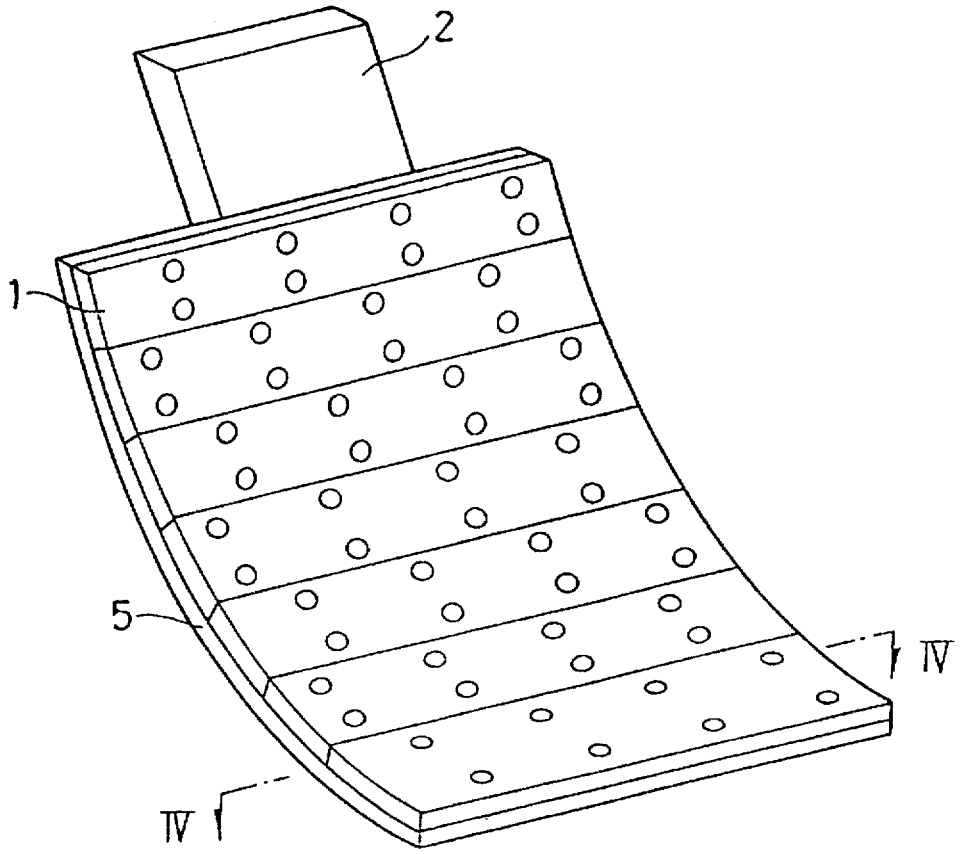
FIG. 3 is a perspective view of a segmented insoluble electrode according to another embodiment of the present invention.
Figure 4:
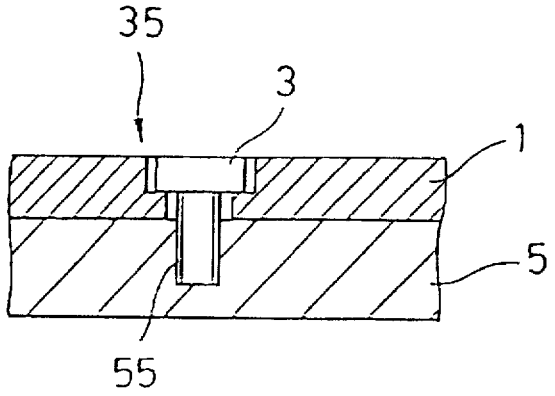
FIG. 4 is a cross-sectional view of the electrode taken along lines IV—IV in FIG. 3.
Figure 5:
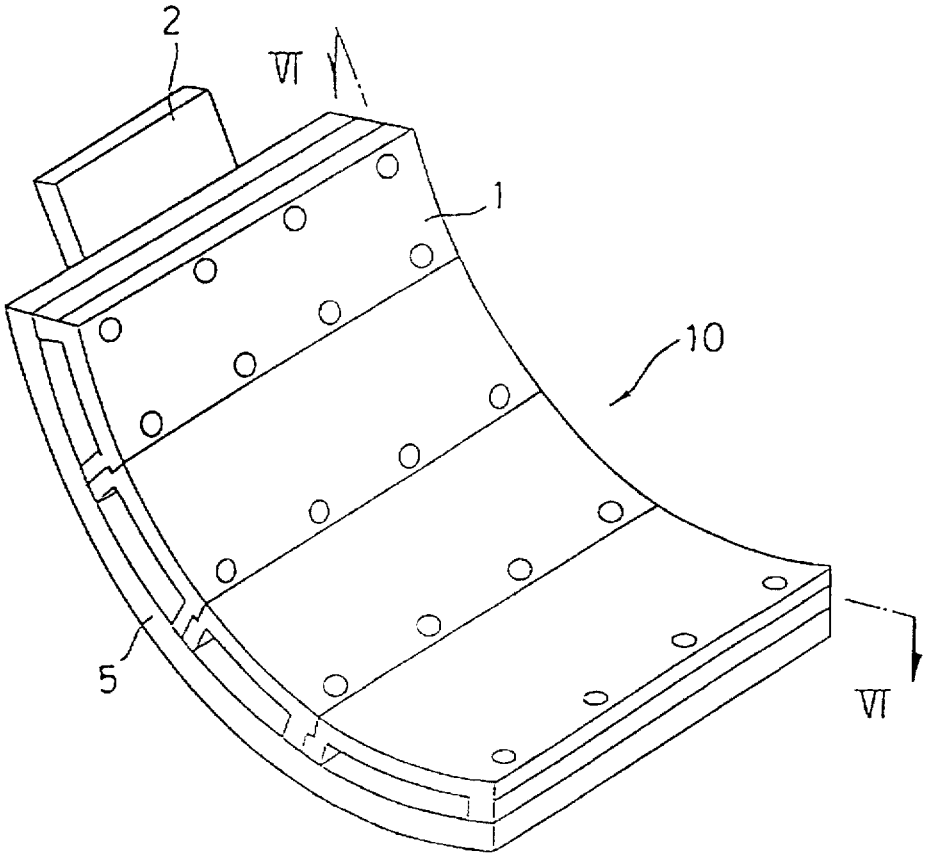
FIG. 5 is a perspective view of a segmented insoluble electrode according to a further embodiment of the present invention.
Figure 6:
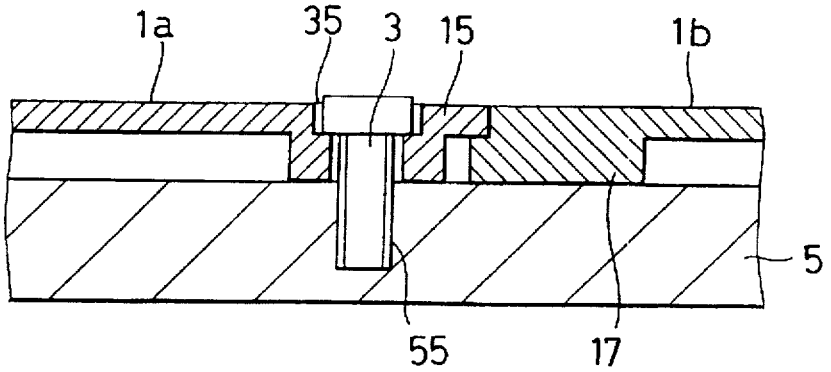
FIG. 6 is a cross-sectional view of the electrode taken along lines VI—VI in FIG. 5.
Figure 8:
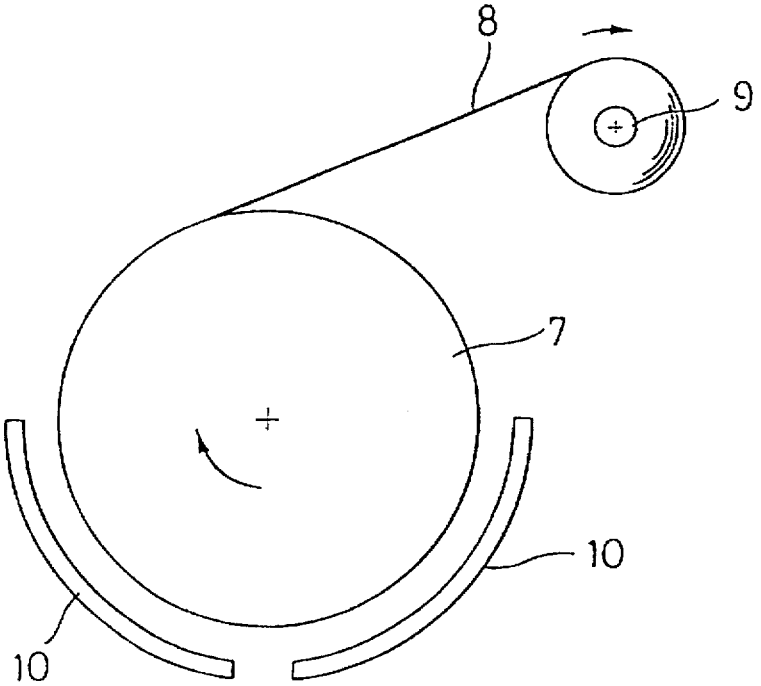
FIG. 8 is a schematic side elevation illustrating an electroplating method according to the present invention.

Referring to FIGS. 1, 3 and 5, there are illustrated different embodiments of a split insoluble electrode according to one embodiment of the present invention, all generally designated at 10. FIGS. 2, 4 and 6 are cross-sectional views of the electrode as viewed in the arrow direction of FIGS. 1, 3 and 5, respectively. The split insoluble electrode 10 serving as an anode includes a plurality of electrode segments 1 which are removably attached to a back plate 5 by conductive bolts 3. The back plate 5 may be a single plate or a segmented plate of any desired structure. The inner surface or inner envelope surface of the electrode preferably defines a curved surface having a predetermined arc component of a cylinder and extending parallel to the axis thereof. One preferred example of the electrode 10 is shown in FIG. 8 as a pair of arcuate electrodes each having a radius of curvature of about 500 to 2,000 mm and an included angle of about 45° to 120° (e.g., about 90° in FIG. 8). The arcuate electrodes 10 are arranged concentrically with a cylindrical cathode drum 7 adapted to rotate about a center axis such that the inner surface of each electrode 10 is opposed to the outer surface of the drum 7 at a predetermined spacing. That is, each electrode 10 defines with the drum 7 a space or flow channel of the predetermined radial spacing for plating solution. It is to be noted that in the arrangement of FIG. 8 including a pair of electrodes 10, plating solution is passed through the flow channels between the electrodes 10 and the drum 7 through the lower slit between the electrodes 10. The terms "circumferential" and "axial" refer to such directions relative to the center axis of the cathode drum 7.

Each of the insoluble electrode segments 1 may be a conductive strip of a corrosion resistant valve metal such as titanium, tantalum, niobium and zirconium and alloys thereof which is typically coated with a platinum group metal and/or oxide thereof such as indium oxide on the surface adapted to face the cathode drum 7. The electrode segment 1 on the side facing the cathode drum 7 may have a continuous smooth curvilinear surface or a somewhat irregular curvilinear surface which is configured regularly (e.g., grid pattern) or randomly for increasing the available surface area. The electrode 10 is divided into a plurality of, preferably 3 to 100, for example, about ten electrode segments 1 (eight segments in FIG. 1) in the circumferential direction, that is, in the rotational direction of the cathode drum shown by an arrow in FIG. 8. Each electrode segment is a strip which is axially elongated and circumferentially arcuate. In the circumferential direction, the segment defines an arc of a short length. The longer sides of the segment extend parallel to the drum axis or perpendicular to the rotational direction of the cathode drum.

In the embodiment shown in FIGS. 1 and 2, bolts 3 of corrosion resistant conductive metal such as titanium are fixedly attached to each electrode segment 1 as by welding. More particularly, the head of bolt 3 (only one shown in FIG. 2) is fixedly attached to the outer surface of electrode segment 1 which is remote from the cathode drum and disposed adjacent the back plate 5.

The back plate 5 is a plate of corrosion resistant conductive metal such as titanium serving for reinforcement or support, shape or dimensional retention and electric conduction. The back plate 5 has the additional function of preventing vortex in the plating solution flow through the channel for preventing any variation in deposit thickness. A plurality of electrode segments 1 are mechanically and electrically connected to the back plate 5 by conductors in the form of bolts 3. More particularly, in FIGS. 1 and 2, the back plate 5 is perforated with a plurality of bolt holes. Since the heads of bolts 3 are fixed attached to the outer surface of electrode segments 1 remote from the cathode drum, the electrode segments are placed on the back plate 5 such that the bolts 3 extend through the corresponding bolt holes in the back plate 5. Then the electrode segments 1 are secured to the back plate 5 by fastening nuts 6 on the bolts 3 through washers 65. Then the attachment of electrode segments 1 to back plate 5 is removable. Such removable attachment allows for ease of maintenance, for example, by removing any damaged segment for repair or replacement with a new segment. In the arrangement shown in FIGS. 1 and 2, an insulating rubber sheet 4 is interposed between the electrode segments 1 and the back plate 5 for preventing the segments 1 from being deformed by nut torquing. A bus bar 2 is connected to the back plate 5 for electric conduction.

FIGS. 3 and 4 show another embodiment in which the electrode segments 1 at the outer surface are in close contact with the back plate 5. The segment 1 at the inner surface is formed with two rows of recesses 35 each for receiving a bolt head while the back plate 5 is formed with bolt holes 55. The segments 1 are secured to the back plate 5 by threading tap bolts 3 into the segments and back plate from the inner surface (cathode drum side) through the recesses 35 and holes 55. The threading torque is carefully controlled so as to avoid deformation of the electrode segments 1. In the above two embodiments, the electrode segments are in substantial abutment.

Figure 7:
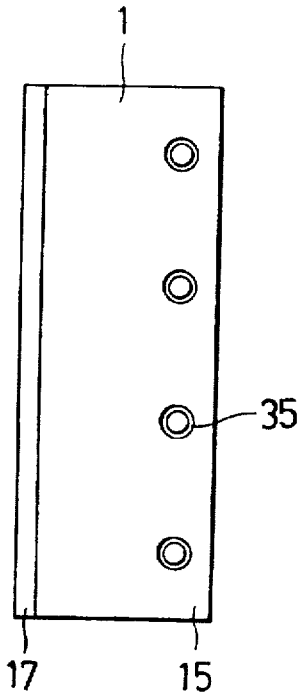
FIG. 7 is a plane view of one of the electrode segments shown in FIG. 5.

FIGS. 5 to 7 show a further embodiment in which electrode segments are in mating engagement. Each electrode segment 1 is provided with pedestals 15 and 17 axially extending along circumferentially opposed edges as shown in FIG. 7. As shown in FIG. 6, two adjacent electrode segments 1*a* and 1*b* have pedestals 15 and 17 along facing edges. The pedestal 15 protrudes toward the back plate 5 and has axially arranged recesses 35 each for receiving a bolt head. The pedestal 15 is shouldered and the pedestal 17 is correspondingly stepped such that the pedestal 15 shoulder is ill mating engagement with the pedestal 17 step when two segments 1*a* and 1*b* are arranged in juxtaposition. The back plate 5 is formed with bolt holes 55. Tap bolts 3 are threaded into segment pedestal 15 and back plate 5 from the inner surface (cathode drum side) through pedestal recesses 35 and back plate bolt holes 55. Threaded engagement of tap bolts 3 secures not only one segment 1*a* by fastening the pedestal 15 to the back plate 5, but also the adjacent segment 1*b* through the mating engagement between the one segment pedestal shoulder and the adjacent segment pedestal step. In this way, a series of electrode segments are removably fixedly secured to the back plate 5 in mutually juxtaposed arrangement. When it is desired to remove one electrode segment for repair, the bolts associated with the segment are removed so that the segment is ready for disassembly.

In these embodiments, the electrode segments 1 are desirably spaced apart from each other on the back plate 5 for providing an increased number of edges. Nevertheless, it will be understood that since electric conduction to the electrode segments 1 is provided from the back plate 5 side, the edges of the respective electrode segments function even when they are closely spaced. From these considerations, the gap between the respective electrode segments is primarily selected such as to provide for easy assembly and disassembly of the electrode segments, for example, 0.1 mm or more. Since substantial vortex flow can occur at larger gaps between electrode segments along the inner surface, the gap should be up to about 5 mm, especially up to about 3 mm.

The rear surface of the back plate 5 which is to be disposed remote from the cathode drum may beta continuous flat surface or include perforations or protrusions. Preferably, the back plate should have a continuous inner surface at least at the gaps between electrode segments for closing the gaps for preventing the solution from passing from the flow channel to the outside of the anode through the gaps and thus preventing occurrence of vortex flow for preventing variations in the deposit thickness.

It is to be noted that an insulating member of inverted T shape (not shown) may be disposed below and between adjacent electrode segments 1 for registrations including flush positioning of the electrode segments and setting of the gap between the electrode segments.

The split insoluble electrode 10 of the above-mentioned construction is used in combination with a cathode drum. As shown in FIG. 8, the electrode 10 is disposed around and approximately concentrically with the cathode drum 7 in a plating tank (not shown) such that the electrode 10 is opposed to the drum 7 at a predetermined spacing. The cathode drum 7 is adapted to be driven for rotation about the axis in the direction shown by an arrow. A power supply (not shown) is connected between the cathode drum 7 and the bus bar 2 connected to the back plate 5 (see FIGS. 1, 3 and 5) for conducting electricity to the electrode 10, thus effecting electrodeposition. As the drum 7 rotates, copper deposits on the drum to form a foil 8 thereon. The copper foil 8 is continuously separated from the drum 7 and wound on a takeup roll 9.

Although the preferred embodiments thus far described refer to copper foil, the invention is equally applicable to other metal foils. The advantage of the invention of minimizing deposit thickness variations is more outstanding in the manufacture of electroplated copper foil of up to 70 μm thick, especially up to 20 μm thick, wherein a deposit thickness variation within 2%, especially within 1% is achieved. Such a minimized deposit thickness variation can be maintained over a long period of time, for example, over one year.

ADVANTAGES

The insoluble anode of the present invention includes a plurality of electrode segments which are circumferentially juxtaposed and removably fixedly secured to a back plate. If any one or more of the electrode segments are locally damaged or deteriorated by possible short-circuiting by anomalous metal (e.g., copper) deposition on the cathode drum, only the necessary segment or segments can be removed from the anode assembly for repair without the need for exchange of the entire anode assembly. This provides for ease of maintenance and repair of the anode and an increased life of the anode itself.

The arcuate anode is circumferentially divided into a plurality of arcuate electrode segments. Each segment is a generally rectangular, axially elongated, circumferentially curvilinear strip. Because of its simple shape, it can be easily shaped and easily coated with a catalytic coating for producing an insoluble electrode, while maintaining a high degree of precision with respect to both the segment dimensions and the coating thickness. The assembly and disassembly operation of the entire anode is easy and the assembly is accomplished to high dimensional precision. As a result, the insoluble electrode has high degrees of precision in configuration, dimensions and coating thickness, which ensures deposition of metal foil (e.g., copper foil) with few defects and of uniform thickness and quality. Since the invention eliminates non-uniformities in deposit thickness and defects which would occur where the anode is axially divided, and significantly reduces the manpower required and low precision assembly occurring where the anode is circumferentially and axially divided into a multiplicity of sections, the invention can afford a length of metal foil, typically copper foil, of high quality.

Additionally, the edge effect is relatively offset by increasing the number of edges within the anode. The variation in deposit thickness is minimized by reducing vortex flow of the plating solution. The present invention prevents the variation in deposit thickness from increasing during continuous operation, ensuring a long life for the anode.

EXAMPLE

These and other advantages are ascertained by the following example which is given by way of illustration and not by way of limitation.

Example

In the arrangement shown in FIG. 8, a cylinder of titanium having a diameter of about 2 m was used for the cathode drum 7. There were used a pair of anodes 10, 10 each including ten segments as shown in FIGS. 1 and 2. Each segment was a titanium strip having a coating formed primarily of $IrO_2$. These segments were circumferentially juxtaposed with a mutual gap of 0.5 mm and removably secured to a back plate. The anodes were disposed around and concentrically with the drum with a radial spacing of about 10 mm such that each anode extended an arc having an angle of 75° about the drum axis.

The cathode drum and the anodes were disposed in a tank which was filled with a plating solution. The plating solution was pumped into the flow channel between the cathode and the anodes through the lower slit between the anodes so that the solution flow is passed upward through the channel whereupon the solution flow exits at the upper opening between the drum and the anode to mix with the tank solution for circulation. The plating solution contained 240 g/l of $CuSO_4.5H_2O$ and 120 g/l of $H_2SO_4$ and had a temperature of 45° C. Electricity (DC) was conducted between the cathode drum and the anodes at a current density of 40 $A/m^2$, causing copper to deposit on the cathode drum. A length of copper foil of 18 μm thick was continuously produced.

At the start of operation, the foil was measured for thickness to find a variation within 1% in a transverse direction. Over one year of continuous operation, the foil thickness was maintained at a variation within 1%. The foil was free of defects such as pinholes and anomalous deposits.

For comparison purposes, continuous operation was carried out under the same conditions as above except that a pair of one-piece anodes having an arcuate cross-section were used. The variation in foil thickness was within 2% at the start of operation and increased beyond 2% after 3 months.

Although some preferred embodiments have been described, many modifications and variations may be made thereto in the light of the above teachings. It is, therefore, to be understood that within the scope of the appended claims, the invention may be practiced otherwise than as specifically described.

We claim:

1. An electroplating apparatus comprising:

a cathode drum adapted to rotate about an axis;

a split insoluble electrode which forms a stationary anode disposed concentrically around the cathode drum to define a channel therebetween, said electrode having a radius of curvature of 500 to 2,000 mm, said anode including a plurality of circumferentially arranged adjacently disposed arcuate electrode segments which define a substantially continuous smooth curvilinear surface, said curvilinear surface having a arc component of a cylinder and extending parallel to said axis, said electrode segments are made of a valve metal material coated with a platinum group metal or an oxide thereof, said anode further including a single conductive back plate of corrosion resistant conductive metal and conductive fixtures for removably attaching said electrode segments to said back plate, each of said electrode segments are positioned adjacent to said back plate and have a first surface which face said cathode drum and a second surface opposed to said first surface which face said back plate, a spacing between said anode and the cathode drum being 5 mm or less, said back plate comprising apertures through which said conductive fixtures extend such that a first end of each of said conductive fixtures are fixed to said second surface of said electrode segments;

attachment means removably positioned on a second end of each of said conductive fixtures for removably attaching each of said electrode segments to said back plate;

means for supplying an electroplating solution containing a metal to the channel between the cathode drum and the anode;

means for conducting electricity between the cathode drum and the anode for depositing the metal on the cathode drum;

means for separating the metal deposit from the cathode drum to obtain a length of electrolytic metal foil having a thickness of up to 70 μm; and an insulating rubber sheet interposed between said electrode segments and the back plate;

wherein the electrode segments on their arcuate surface are separated from each other by a distance of 0.1 to 5 mm.

2. The apparatus of claim 1 wherein the means for supplying an electroplating solution to the channel includes means for channeling the solution through the channel.

3. The apparatus of claim 1 which further includes a tank adapted to be filled with the electroplating solution so as to permit said cathode drum and the anode to be dipped therein.

4. The apparatus of claim 1 wherein the anode extends an arc having an included angle of 45° to 120° with respect to the drum axis.

5. The apparatus of claim 1 wherein the channel between the anode and the cathode drum has a radial distance of about 10 mm.

6. The apparatus of claim 1, wherein said metal is copper.

7. The apparatus of claim 1, wherein said distance of separation of the electrode segments on their arcuate surface is 0.1 to 3 mm.

8. An electroplating method comprising the steps of:

adjacently disposing a plurality of arcuate electrode segments of a valve metal substrate coated with a platinum group or an oxide thereof to define a substantially continuous smooth curvilinear surface;

removably attaching and electrically connecting said plurality of electrode segments on a single conductive back plate of corrosion resistant conductive metal to form a stationary anode which defines a split insoluble electrode, said electrode having a radius of curvature of 500 to 2,000 mm;

placing a rotating cathode drum and said stationary anode at a spacing therebetween such that a facing surface of each of said electrode segments opposite an underside surface faces said cathode drum, said spacing being 5 mm or less and said stationary anode is disposed around and concentrically with the cathode drum;

providing an electroplating solution containing a metal between said cathode drum and said anode;

conducting electricity between said cathode drum and said anode for depositing the metal on said cathode drum; and separating the metal deposit from said cathode drum to obtain a length of an electrolytic metal foil having a thickness of up to 70 μm;

said removably attaching and electrically connecting step comprising the steps of:

passing fastening means through apertures in said back plate in a direction toward said electrode segments and fixing one end of said fastening means to said underside surface of said electrode segments; and removably attaching an attachment means onto a second end of said fastening means to permit removable attachment of said plurality of electrode segments to said back plate;

wherein said electrode segments on their surface facing the cathode drum are separated from each other by a distance of 0.1 to 5 mm.

9. The method of claim 8, wherein said metal is copper.

10. The method of claim 8 wherein the step of providing an electroplating solution containing a metal between the cathode drum and the anode includes channeling the solution between the cathode drum and the anode.

11. The method of claim 8, wherein said separation distance of said electrode segments on their surface facing the cathode drum is 0.1 to 3 mm.

12. An electroplating apparatus comprising:

(a) cathode drum adapted to rotate about an axis;

(b) a split insoluble electrode in the form of a stationary anode disposed around said cathode drum to define a channel therebetween, said anode comprising:

(i) a plurality of arcuate circumferentially arranged electrode segments adjacently positioned on a back plate, each of said electrode segments comprising at least one integral pedestal portion which axially extends from an edge of said electrode segments, such that a pedestal portion on a first electrode segment positioned on said back plate overlaps a pedestal portion on an adjacently positioned second electrode segment on said back plate to define a smooth curvilinear surface; and (ii) attachment means for removably attaching said electrode segments to said back plate;

(c) means for supplying an electroplating solution containing a metal to the channel between said cathode drum and said anode;

(d) means for conducting electricity between the cathode drum and the anode for depositing the metal on the cathode drum; and (e) means for separating the metal deposit from the cathode drum to obtain a length of electrolytic metal foil.

13. The anode of claim 12, wherein said electrode segments are disposed concentrically with the cathode drum.

14. The anode of claim 12 wherein said electrode segments on their arcuate surface are separated a distance of 0.1 to 5 mm.

15. The apparatus of claim 12, wherein electrode segments are formed of a valve metal material coated with a platinum group metal or a oxide thereof.

16. The apparatus of claim 12, wherein said attachments means comprises:

apertures formed on one of said opposed pedestal portions on each of said electrode segments which align with apertures on said back plate; and bolt means for insertion through said aperture on said one pedestal portion and into said aperture on said back plate for maintaining the juxtaposed mating pedestal portions on adjacent electrode segments on said back plate.

* * * * *

UNITED STATES PATENT AND TRADEMARK OFFICE

CERTIFICATE OF CORRECTION

PATENT NO. : 5,628,892

DATED : MAY 13, 1997

INVENTOR(S) : YUKIO KAWASHIMA ET AL.

It is certified that error appears in the above-indentified patent and that said Letters Patent is hereby corrected as shown below:

IN THE CLAIMS

Claim 12, line 2, before "cathode" insert --a--, delete "adapted to rotate" and insert --which rotates--.

Claim 15, line 3, change "a oxide" to --an oxide--.

Signed and Sealed this

Seventh Day of October, 1997

*Attest:*

Bruce Lehman

BRUCE LEHMAN

*Attesting Officer*

*Commissioner of Patents and Trademarks*